United States Patent [19]

Andruchiw

[11] 4,260,067

[45] Apr. 7, 1981

[54] SAFETY CLOSURE

[76] Inventor: Roman Andruchiw, 137 Spring Garden Ave., Willowdale, Ontario, Canada, M2N 3G6

[21] Appl. No.: 85,865

[22] Filed: Oct. 18, 1979

[30] Foreign Application Priority Data

Oct. 20, 1979 [CA] Canada ..... 313855

[51] Int. Cl.[3] ..... B65D 55/02

[52] U.S. Cl. ..... 215/225; 215/216; 215/274; 215/301; 215/317

[58] Field of Search ..... 215/216, 220, 225, 274, 215/301, 317

[56] References Cited

U.S. PATENT DOCUMENTS

| | | | |
|---|---|---|---|
| 3,469,725 | 9/1969 | Turner | 215/225 |
| 3,612,322 | 10/1971 | Linkletter | 215/225 |
| 3,862,699 | 1/1975 | Wetzell | 215/216 |

*Primary Examiner*—George T. Hall

*Attorney, Agent, or Firm*—James T. Wilbur

[57] ABSTRACT

The closure consists of inner and outer caps which are disposed concentrically about the mouth of a container. A flap or latch is cut into the side wall of the inner cap and the latch is biased such that its upper edge is normally disposed beneath a lip formed in the brim of the container to lock the inner cap about the mouth of the container. The outer cap is maintained concentrically about the inner cap by means of the lower edge of the latch which is accommodated in an annular groove formed in the inside wall of the outer cap. The caps may be removed from the container by first forcing the outer cap downwardly relative to the inner cap. As the outer cap moves downwardly the wall of its groove contacts the lower portion of the latch and causes the latch to pivot to a position at which its upper edge is no longer beneath the brim lip. Secondly the inner cap is grasped along with the outer cap and the two caps are removed together as a unit from the container.

8 Claims, 12 Drawing Figures

SAFETY CLOSURE

BACKGROUND OF THE INVENTION

This invention relates to safety closures for use on containers for the purpose of preventing unauthorized access to their contents. More specifically the present invention relates to safety closures which may be used in conjunction with containers of any shape whatever provided the containers have a rim or flange around the outer peripheries of their mouths.

Various types of locking mechanisms are known for retaining the caps on containers intended to hold medicines, cleaning solvents and like toxic substances. The primary objective of such locking mechanisms is to foil the attempts by young children to remove the caps from the containers. To open such locking mechanisms requires a manual dexterity or strength not usually possessed by young children or requires reading and following of written instructions. Typical of such locking mechanisms is that described in U.S. Pat. No. 3,862,699 to Wetzell. Wetzell describes a closure for a bottle which, to open, requires that it be first depressed, secondly squeezed radially inwardly and thirdly rotated with respect to the bottle to a point at which ridges formed in the closure may be moved into conforming depressions formed in the neck of the bottle. These steps require not only strength and manual dexterity but the ability to follow written instructions. A yound child would be unable to open such a closure.

A shortcoming of known locking mechanisms such as that described in Wetzell is that they can only be used in conjunction with specially constructed containers. The containers must usually, for example, be provided with specially constructed ribs or grooves adjacent their mouths for cooperation with conforming grooves or ribs of the locking mechanisms. Moreover, the mouths of the containers must be cylindrical since the known locking mechanisms must usually be rotated in order to remove them from the containers.

Another shortcoming of many known locking mechanisms is that they are structurally complex. Not only are the mechanisms expensive of construction but they are complicated of assembly.

SUMMARY OF THE INVENTION

It is an object of the present invention to provide a closure which may be used in conjunction with a container having a mouth of any shape provided the mount of the container has a rim or flange around its outer periphery.

Another object of the invention is to provide a closure which is simple of construction and assembly but which requires both manual dexterity and the ability to read and follow instructions to open.

Another object of this invention is to provide a closure consisting of only two components both of which being readily molded of polymeric material.

These and other objects of the invention are accomplished by a closure for a container having a mouth defined by a brim that includes an outwardly directed lip. The closure comprises an inner cap; a latch which is normally in a locked position in which the latch extends beneath the lip for securing the inner cap over the mouth of the container but which is deflectable to an unlocked position in which the latch is withdrawn from beneath said lip; an outer cap having means which contacts the inner cap for preventing separation of the outer cap from the inner cap when the latter is over the mouth of the container but which permits limited relative movement between the outer and inner caps. The outer cap when moved relative to the inner cap in a direction toward removal thereof from the container moves from a first position to a second position. The closure further has deflecting means which, when the outer cap is in the first position contacts the latch and causes the same to deflect to the unlocked position and which, when the outer cap is in the second position, permits the latch to assume the normally locked position. The closure also includes means for holding the outer cap in the second position. The outer cap is removable from the container by applying a force thereto opposed to the holding means to cause the outer cap to move to the first position and thereafter causing simultaneous removal of the outer and inner caps from the container.

DESCRIPTION OF THE DRAWINGS

The invention will now be described further with reference to the accompanying drawings in which.

Figure 6:
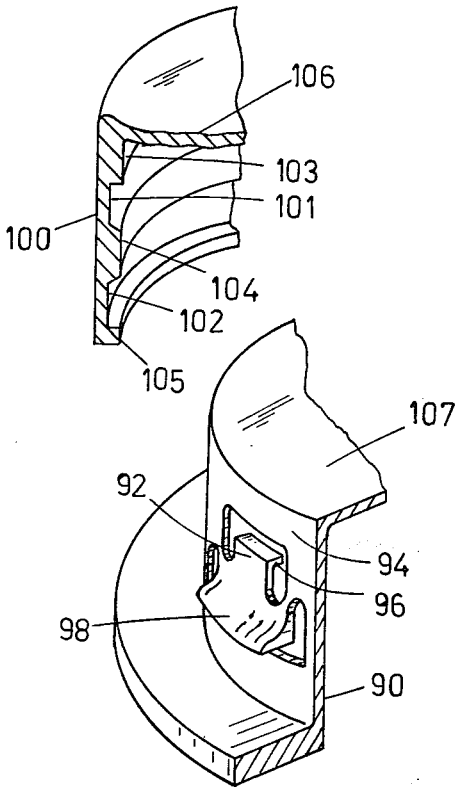
Figure 7:
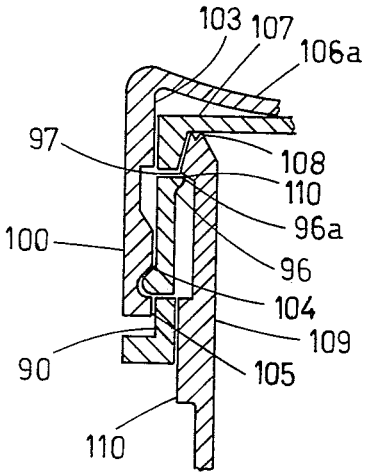
Figure 8:
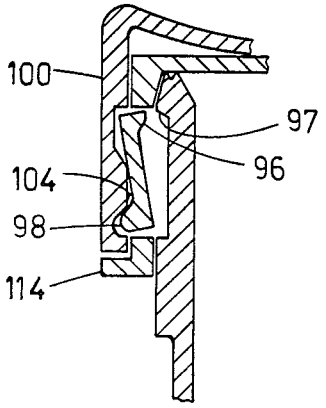
Figure 9:
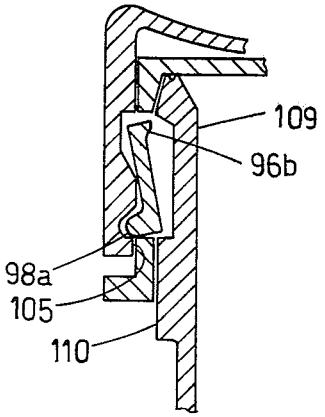
Figure 10:
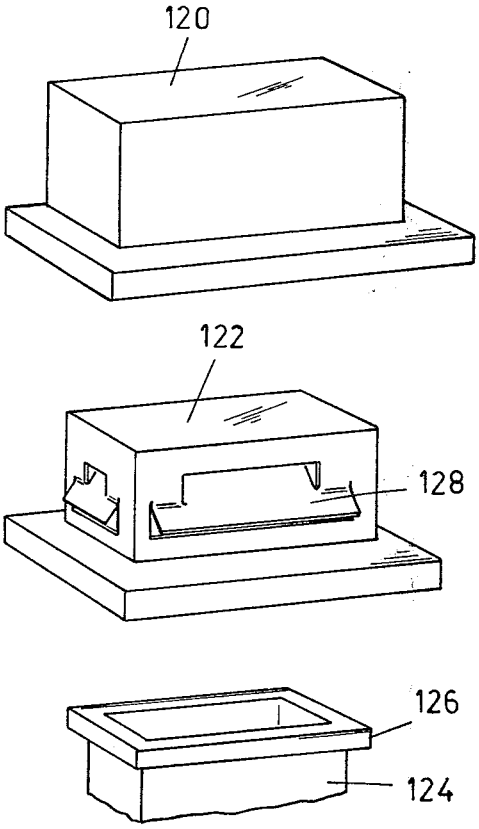

FIGS, 3, 4 and 5 are sections of second, third and fourth embodiments respectively of the inner and outer caps of the invention each shown connected to the mouth of a container;

FIG. 6 is a perspective view, partly in section of a fifth embodiment of inner and outer caps shown in a disconnected relationship; FIGS. 7 to 9 are sections of the positions which the inner and outer caps of FIG. 6 take when they are connected (FIG. 7) and when they are in the process of being removed (FIG. 8) and connected (FIG. 9) to the mouth of a container;

FIG. 10 is a perspective view of a sixth embodiment of the caps of the invention shown in conjunction with the upper portion of the neck of a container.

Figure 11:
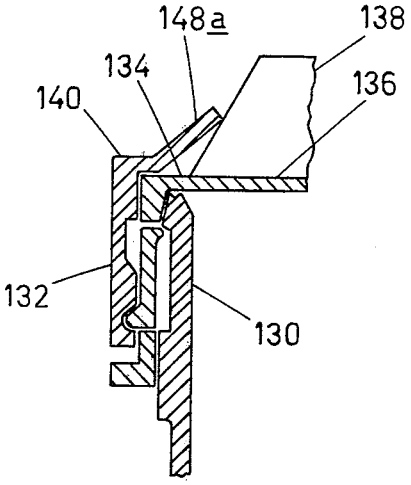
Figure 12:
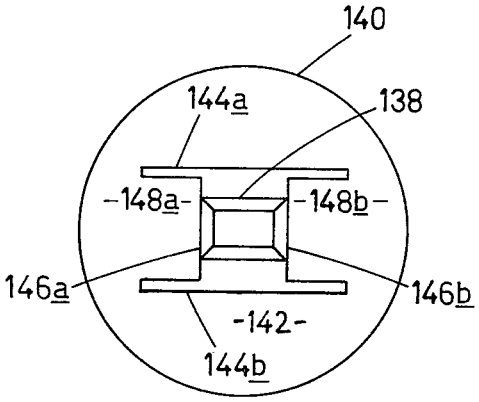

FIG. 11 is a partial section of a seventh embodiment of the inner and outer caps shown connected to the mouth of the container; and FIG. 12 is a plan view of the outer and inner caps illustrated in FIG. 11.

DESCRIPTION OF THE PREFERRED EMBODIMENTS

Figure 1:
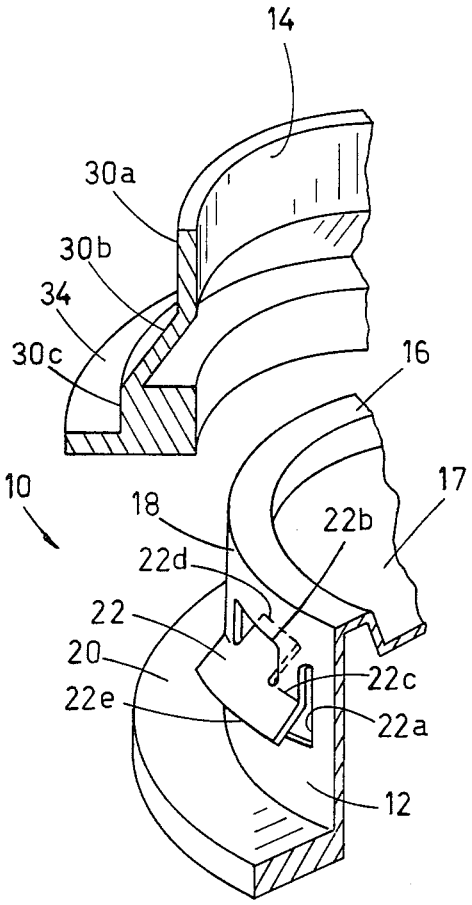
FIG. 1 is a perspective view, partly in section, of portions of one embodiment of the inner and outer caps of the invention in a disconnected relationship.

With reference made to FIG. 1, the closure of the invention is indicated generally by the numeral 10 and comprises an inner cap 12 and an outer cap 14. The inner cap is provided with an upper cross-axially inwardly extending lip 16 which is connected to a circular lid 17. The lid extends across the mouth of the container and prevents access to the contents of the container. The other side of the lip is connected to an annular side wall 18. The lower edge of the side wall is connected to a cross-axially outwardly extending lower wall or flange 20.

Figure 2:
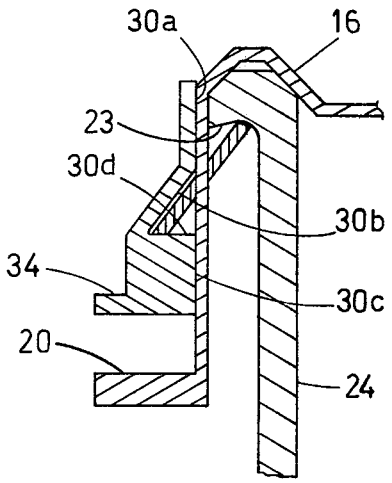
FIG. 2 is a section of the inner and outer caps of FIG. 1 shown connected to the mouth of a container.

A latch 22 is cut from the side wall 18. The latch is formed by a pair of longitudinally spaced U-shaped cuts **22*a*, 22*b* in the side wall 18 of the inner cap. The lower cut 22*a* is upwardly opening while the upper cut 22*b* is downwardly opening and the latch thus formed is pivotable relative to side wall 18 along a line 22*c* which extends transversely along the side wall between the pair of cuts. Latch 22 in its normal position assumes the illustrated position where its upper edge 22*d* is disposed radially inwardly of the side wall 18 while its lower edge 22*e* is disposed radially outwardly of the side wall. In such position, as illustrated in FIG. 2, the upper edge of the latch is disposed beneath the lip 23 of the brim of container 24. The inner cap is thus locked to the container since the latch prevents the cap from being raised relative to the container and the lip 16** prevents the cap from being lowered relative to the container.

When the lower portion of the latch (beneath hinge **22*c*) is subjected to a force directly downwardly, generally parallel to the axis of the cap, or to a radially inwardly directed force, the latch will deflect toward an upright position at which it is co-planar with the side wall 18 of the cap. In such position the upper edge 22*d*** of the latch is disposed outwardly of the lip and in an unlocked position since the inner cap can be raised relative to the container without hindrance by the latch.

The side wall 18 of the inner cap, and preferably the entire inner cap is formed of resilient material so that the application of a force causing the latch to deflect to an unlocked position will cause resilient deformation of the latch adjacent its hinge. Withdrawal of the force will result in a return to the latch to the locked position illustrated in FIG. 1. Preferably the inner cap is composed of resilient polymeric material, such as polypropylene or linear polyethylene.

Where the inner cap is composed of polypropylene or linear polyethylene, the latch may be formed simply by making appropriate cuts in the side wall of the cap, applying a force to the thus-cut side wall to cause the latch to assume the position illustrated in FIG. 1 and applying sufficient heat to cause the latch to remain permanently at the deformed position unless subjected to the aforementioned deflecting force.

As illustrated in FIG. 2 the outer cap is constructed so that it may be placed concentrically about the inner cap. The outer cap 14 is provided with an annular side wall 30 having upper, intermediate and lower surfaces **30*a, b, c,* respectively. The inside diameter of the upper surface 30*a* is the same or slightly greater than the outer diameter of the side wall 18 of the inner cap. The intermediate surface 30*b* extends radially, outwardly and downwardly of the upper portion at generally the same angle as the latch in an undeformed state and the lower surface 30*c* is of the same inside diameter as the upper surface. A cross-axially, outwardly extending flange 34** is formed at the lower edge of the outer cap.

When the outer cap is disposed concentrically about the inner cap, the lower edge **22*e* of the latch contacts the cross-axially inwardly extending area 30*d* of the outer cap. The latch serves as a means of holding the outer cap in the position illustrated in FIG. 2** since upward movement of the outer cap relative to the inner cap causes the latch to rotate clockwise and such rotation is prevented by the resistance of the outer wall of the container to sliding movement of the upper edge of the latch. Downward movement of the outer cap is opposed but not prevented by the bias of the latch.

The operation of the inner and outer caps is described with reference to FIG. 2. In that figure, the inner and outer caps are disposed concentrically about the brim of container 24. The outer cap is locked to the inner cap by means of latch 22 and the inner cap is locked to the container also by means of the latch.

The order to remove the caps from the brim, the outer cap must be grasped and forced downwardly in a direction generally parallel to the axis of the cap to cause it to move downwardly relative to the inner cap. When such a force is applied, the intermediate surface **30*b* of the inside wall of the outer cap contacts latch 22 and acts as a deflecting means for causing the latch to deform or deflect to an upright position. As the latch deflects, its upper edge 22*d* moves outwardly of the lip 23** of the container.

Downward movement of the outer cap relative to the inner cap is arrested when the lower flanges 20,34 of the two caps come into contact with each other. The outer cap is then in a first position with respect to the inner cap and the latch is in an unlocked position. The latch can be secured in this position by grasping the lower flange 20 in addition to the outer cap so that relative movement between the two caps is prevented. The caps may then be removed from the container provided the caps are held together in the first position and removed simultaneously.

Any attempt to remove the caps individually from the container and not as a unit will fail short of fracturing one or both of the caps. Should, for example, the outer cap be raised from the first position at which the two lower flanges of the caps contact each other without at the same time grasping the inner cap, the latch will assume the normal undeformed state illustrated in FIG. 1 since the deflecting force applied to the latch by the inner wall of the outer cap will be absent. The outer cap will then be in the position illustrated in FIG. 2 with respect to the inner cap. This position will be sometimes referred to below as the "second position". Further upward movement of the outer cap relative to the inner cap from the second position is prevented by the upper edge of the latch as previously described.

Raising of the inner cap but not the outer cap from the first position will likewise be impossible since the deflecting force applied to the latch by the outer cap will be removed when the outer cap is released and the latch will resume its normal locked position where its upper edge will prevent removal of the inner cap from the container.

Figure 3:
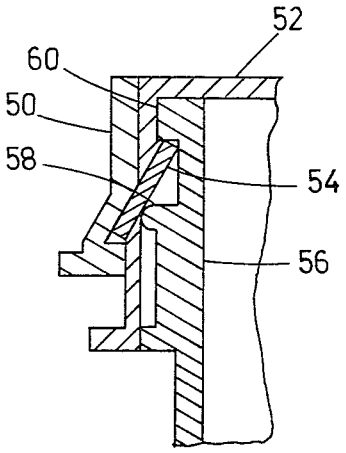

With reference to FIG. 3, the illustrated closure comprises an outer cap 50 and an inner cap 52. Both the inner and outer caps have generally the same structure as the inner and outer caps 12,14 of FIGS. 1 and 2 except that latch 54 formed on the inner cap of FIG. 3 is not biased into an oblique relationship with the side wall of the cap as is the latch illustrated in FIGS. 1 and 2. Rather latch 54 is simply cut from the side wall and remains in a co-planar relationship with the side wall unless subjected to a force which causes it to deflect.

When the inner cap is placed concentrically about the neck 56 of a container, ridge 58 which is formed on the outer wall of the neck contacts the lower portion of the latch beneath the hinge and causes the latch to deflect to the illustrated position in which the upper edge of the latch is beneath the cross-axially extending lower wall of lip 60 of the container and the lower edge of the latch contacts the inner wall of the outer cap.

Latch 54 in the position illustrated in FIG. 3 serves to lock the inner cap about the neck of the container and holds the outer cap to the inner cap. Removal of the caps from the container is accomplished in the same manner as removal of the caps of FIGS. 1 and 2, namely the outer cap 50 is depressed until its lower flange contacts the lower flange of the inner cap. The two caps are then raised together as a unit and removed from the container.

Figure 4:
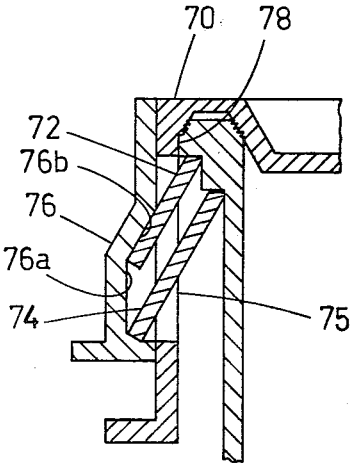

In FIG. 4, the inner cap 70 is of the same construction as the inner cap of FIGS. 1 and 2 except that two vertically spaced latches 72,74 are formed in the side wall 75 of the cap. The latches are biased into an oblique relationship with side wall 75 by resilient means and are arranged and constructed such that as the upper latch 72 deflects to an upright position, it contacts the lower portion of the lower latch 74 and causes deflection of the lower latch. Since the latches must contact each other when deflected they cannot simply be cut from the side wall of the cap, unlike the latch of FIGS. 1 and 2, but must be formed apart from the inner cap and physically attached to the cap.

Outer cap 76 is generally of the same construction as the outer cap of FIGS. 1 and 2 except that it is lengthened at 76*a* beneath its intermediate surface 76*b* for accommodation of the lower latch 74.

In operation, when the outer cap is lowered with respect to the inner cap the intermediate surface 76*b* of its inner wall contacts and deflects the upper latch 72 which, in turn, contacts and deflects the lower latch 74. When both latches are in an upright position, their upper edges clear the stepped lip 78 of the container and the outer cap may then be removed from the container by raising it simultaneously with raising of the inner cap.

Figure 5:
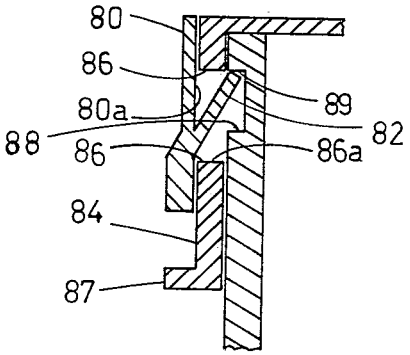

With reference to FIG. 5, the outer cap 80 is provided with a latch 82 which extends inwardly at an oblique angle from its inner wall 80*a*. The latch is resiliently deflectable to an upright position but returns to the illustrated position when a deflecting force is removed.

The inner cap 84 has a generally rectangular aperture 86 formed therein through which the latch extends. A flange 87 extends radially outwardly from the lower portion of the inner cap.

In order to remove the inner and outer caps of FIG. 5 from a container, the outer cap is first moved downwardly with respect to the inner cap in order to bring the lower edge 86*a* of the aperture formed in the inner cap and the lower edge 88 of the groove in the container both into contact with the latch. Further lowering of the outer cap will cause the latch to deflect to an upright position whereby its upper edge clears the lip 89 of the container. In order to maintain the latch in a deflected position, the inner and outer caps are both grasped and are removed as a unit from the container.

Removal of the caps cannot be accomplished simply by raising inner cap 84 since by so doing the latch will be contacted only at its base by edge 86*a* and an upward force applied only at that point will not cause the latch to rotate to an upright position.

With reference to FIGS. 6 and 7 an inner cap 90 has a latch 92 cut into its side wall 94. Like the latch 22 of FIGS. 1 and 2, latch 92 is hinged to the side wall intermediate its upper and lower edges but unlike latch 22, latch 92 is biased by resilient means into a generally coplanar relationship with the side wall. Moreover, in contrast to latch 22, latch 92 is provided with upper and lower beads 96,98 which extend radially inwardly and outwardly respectively adjacent its upper and lower edges. The inner cap is constructed such that the upper edge 96*a* of the upper bead contacts the lower wall 97 of the lip of the container when the inner cap is connected to the container.

Outer cap 100 has an inner wall in which is formed two parallel vertically spaced annular grooves 101,102 which separate the wall into upper, intermediate and lower surfaces 103,104,105 respectively. The upper edge of the side wall terminates at a concave lid 106 which extends across and serves to close the mouth of the cap. As illustrated in FIG. 7, lid 106 at its lower most extent 106*a* contacts the lid 107 of the inner cap.

Outer cap 100 is formed of resilient material such as polypropylene or linear polyethylene. When the cap is forced downwardly to the position illustrated in FIG. 8, the lid 106 flexes resiliently and when the force is removed, the lid resumes its concave shape thereby raising the side wall of the cap to the position illustrated in FIG. 7.

With further reference to FIG. 7, concentric V-shaped grooves 108 are formed in the upper edge of the brim of container 109. The container is preferably formed of material such as acrylic or styrene which is harder than the material of the inner cap so that the sharp upper edges at the brim dig into the lid 107 of the inner cap and thereby form a vapour barrier. A flange 111 extends outwardly from the container and contacts the lower portion of the inner cap and thereby stabilizes the cap when connected to the container as illustrated.

The inner and outer caps are removed from the neck of the container by first lowering the outer cap 100 with respect to the inner cap to the position illustrated in FIG. 8. As the outer cap is lowered, the intermediate surface 104 contacts lower bead 98 and causes the lower portion of the latch to deflect resiliently inwardly. As the latch deflects, the upper bead 96 moves outwardly of the lip to an unlocked position. The lower wall 97 of the lip is beveled so that the upper bead may swing to the illustrated position without hindrance by the lip.

The inner and outer caps may then be removed from the container by grasping the lower flange 114 of the inner cap while the lower most surface of the outer cap is held in contact therewith. The two caps may then be removed by raising them together as a unit.

With reference to FIG. 9, the outer and inner caps are shown in the process of being connected to the neck of the container. First the inner cap is placed concentrically about the neck of the bottle and pressed downwardly. Since the lower portion of the latch is generally coplanar with the inside wall of the cap it does not contact the lip of the container and impede downward movement of the cap. When the beveled lower edge 96*b* of the upper bead contacts the lip, the latch swings counterclockwise until the bead is below the lip whereupon the bead snaps beneath the lip to lock the inner cap about the neck. In this position the upper edges of the brim of the container digs into the lid of the cap to seal the cap to the container as previously described and the upper edge 96*a* of the latch digs into the beveled lower wall 97 of the lip.

As the outer cap is lowered concentrically about the inner cap, its lower surface 105 contacts the beveled upper edge 98*a* of the lower bead and causes the latch to swing counterclockwise until the bead is clear of the surface whereupon the latch returns to its normal upright position as illustrated in FIG. 7 thereby locking the outer cap to the inner cap.

In the foregoing specification all of the described caps have been annular or cylindrical in shape. However, since removal of the caps does not require rotational movement of the caps they need not have such shape. The caps may be rectangular, triangular or any other shape so long as they have openings which conform to the shape of the neck of the container, in the case of inner caps or which conform to the shape of the inner caps in the case of outer caps. The caps illustrated in FIG. 10 are illustrative of non-annular or non-cylinderical caps.

In FIG. 10, outer and inner caps 120,122 are rectangular in section and are intended for use as a closure for a container having a neck 124 which is rectangular in section. The neck is provided with a lip 126 below which is disposed the upper edge of the latch 128 formed in the inner cap when the latter cap is in position about the neck.

Latch 128 is of the same shape and construction as the latch illustrated in FIGS. 1 and 2. Similarly, the inner wall of the outer cap (not illustrated) is of the same shape as the inner wall of the outer cap of FIGS. 1 and 2. The operation of latch 128 is thus the same as that of the latch of FIGS. 1 and 2 and the outer and inner caps of FIG. 10 are removed from the container in the identical manner.

The inner and outer caps 130,132 illustrated in FIGS. 11 and 12 have the same construction as the caps illustrated in FIGS. 7 to 9 with the exception of the construction of the lids. The lid 134 of the inner cap is composed of a circular cross-axially extending lower wall 136 which serves to close the mouth of the cap and an upstanding fin 138. The fin tapers upwardly and its lower edge extends diametrically across the upper face of the lower wall 136.

With reference to FIG. 12 the lid 140 of the outer cap is composed to a circular cross-axially extending wall 142 which is parallel to and is disposed immediately above wall 136 of lid 134. Formed in wall 142 are two parallel cuts 144*a,b* and two further smaller parallel cuts 146*a,b*. The latter cuts are disposed at right angles to the former cuts 144*a,b* and extend therebetween.

Cuts 146 and the central portions of cuts 144 define a rectangular central opening in wall 142 and the remaining outer portions of cuts 144 and cuts 146 define two tabs 148*a,b*. The tabs are thus integral with wall 142 and lie on opposite sides of the central opening.

Fin 138 of the inner cap extends through the central opening and is contacted by the edges of the tab which are defined by cuts 146. As illustrated in FIG. 11, tabs 148 are deformed by the side edges of the fin when the inner and outer caps are positioned concentrically about the neck of container 130. The tabs prevent removal of the outer cap from the container but allow the outer cap to be forced downwardly relative to the inner cap to the position at which the two caps may be removed as a unit. When the force is removed the outer cap returns to the illustrated position under the bias of the tabs.

It will be understood of course that modifications can be made in the preferred embodiments of the invention described and illustrated herein without departing from the scope and purview of the invention as defined in the appended claims.

The embodiments of the invention in which an exclusive property of privilege is claimed are defined as follows:

1. A closure for a container having a mouth defined by a brim that includes an outwardly directed lip, said closure comprising an inner cap; a latch which is normally in a locked position in which said latch extends beneath said lip for securing said inner cap over the mouth of the container but which is deflectable to an unlocked position in which said latch is withdrawn from beneath said lip; an outer cap having means which contacts said inner cap for preventing separation of said outer cap from said inner cap when the latter is over the mouth of the container but which permits limited relative movement between said outer and inner caps, said outer cap when moved relative to the inner cap in a direction toward removal thereof from the container moving from a first position to a second position; deflecting means which, when said outer cap is in said first position contacts said latch and causes same to deflect to said unlocked position and which when said outer cap is in said second position, permits said latch to assume said normally locked position; and means for holding said outer cap in said second position, said outer cap being removable from the container by applying a force thereto opposed to the holding means to cause said outer cap to move to said first position and thereafter causing simultaneous removal of said outer and inner caps from the container.

2. A closure for a container having a mouth defined by a brim that includes an outwardly directed lip, said closure comprising inner and outer caps adapted to surround the brim and inner cap respectively, said inner cap having in its side wall a latch formed by a pair of longitudinally spaced U-shaped cuts the lower of which being upwardly opening while the upper cut being downwardly opening, said latch being pivotable relative to the side wall along a line which extends transversely along the side wall between the pair of cuts, said latch further being normally in a locked position in which an upper portion of said latch extends beneath said lip for securing said inner cap over the mouth of the container but which is deflectable to an unlocked position in which said latch pivots away from beneath said lip; an outer cap having an inside wall in which is formed a groove which accommodates a lower portion of said latch and which by so doing prevents separation of said outer cap from said inner cap when the latter is over the mouth of the container, said outer cap being movable relative to said inner cap and in a direction opposite to that of removal from said container from a second position to a first position by the application of force thereto which causes a wall of said groove to contact said lower latch portion with resulting deflection of said latch to said unlocked position, said outer cap when returned to said second position causing said latch to return to its normally locked position; and means for holding said outer cap in said second position, said outer cap being removed from the container by applying a force thereto opposed to the holding means to cause said outer cap to move to said first position and thereafter causing simultaneous removal of said outer and inner caps from the container.

3. The closure as claimed in claim 1 wherein said inner cap surrounds said brim and said outer caps surrounds the inner cap, and latch being formed on the inner cap as is said deflecting means.

4. The closure as claimed in claim 1, wherein said latch is biased resiliently into said locked position.

5. The closure as claimed in claim 2 including resilient means which biases said latch into said locked position and which also acts as said holding means by causing the lower latch portion to bias the outer cap into said second position.

6. The closure as claimed in claim 1, wherein said holding means is in the form of a lid which is integral with the outer cap and which is normally downwardly concave in shape but which deforms resiliently upon the application of a force required to cause said outer cap to move to said first position and which resiliently resumes its normally concave shape upon removal of the force thereby causing the outer cap to return to said second position.

7. The closure as claimed in claim 1, wherein said latch is movably freely without hindrance by resilient means between said first and second positions but is maintained in said lock position by means of a ridge which is formed on said container and which extends outwardly and into contact with said latch and which thereby causes said latch to assume said locked position in the absence of a force applied thereto by said deflecting means.

8. The closure as claimed in claim 1, wherein said holding means comprises a pair of tabs which are integral with a lid of said outer cap and which are disposed on opposite sides of a central opening formed in said lid, said holding means further including an upwardly tapering fin extending from a lid of said inner cap and through the central opening of the outer cap, said tabs contacting and being resiliently deformed by said fin and thereby holding said outer cap in said second position, said tabs deforming further upon the application of a force to allow said outer cap to move to said first position but upon removal of the force returning to their less deformed position thereby restoring said outer cap to said second position.

* * * * *